US006615445B2

(12) United States Patent
Wörwag

(10) Patent No.: US 6,615,445 B2
(45) Date of Patent: Sep. 9, 2003

(54) VACUUM CLEANING TOOL WITH DIRECT FLOW TURBINE

(75) Inventor: Peter Wörwag, Staad (CH)

(73) Assignee: Düpro AG, Romanshorn (SE)

( * ) Notice: Subject to any disclaimer, the term of this patent is extended or adjusted under 35 U.S.C. 154(b) by 0 days.

(21) Appl. No.: 09/943,557

(22) Filed: Aug. 30, 2001

(65) Prior Publication Data

US 2002/0042967 A1 Apr. 18, 2002

(30) Foreign Application Priority Data

Aug. 31, 2000 (DE) ..... 100 42 672

(51) Int. Cl.[7] ..... A47L 5/30
(52) U.S. Cl. ..... 15/387
(58) Field of Search ..... 15/387

(56) References Cited

U.S. PATENT DOCUMENTS 5,249,333 A 10/1993 Wörwag ..... 15/387
5,950,275 A * 9/1999 Worwag ..... 15/387
6,151,752 A * 11/2000 Melzner et al. ..... 15/387

* cited by examiner

*Primary Examiner*—Theresa T. Snider
(74) *Attorney, Agent, or Firm*—Gudrun E. Huckett

(57) ABSTRACT

A vacuum cleaning tool has a housing with a brush chamber and a turbine chamber. A vacuum connector is connected to the housing remote from the brush chamber and has an outlet window. A working roller is arranged in the brush chamber and driven by an air turbine in the turbine chamber. The air turbine has an annular vane arrangement with vanes. The vacuum airflow enters the brush chamber via a suction slot, flows from the brush chamber into the turbine chamber, passes through the air turbine, and exits through the outlet window of the vacuum connector. In the flow direction of the vacuum airflow the outlet window is higher than the intake window. A connecting line between central areas of the intake and outlet windows intersects the air turbine as a secant to define a circle segment in which four to six of the vanes of the annular vane arrangement are located.

20 Claims, 2 Drawing Sheets

VACUUM CLEANING TOOL WITH DIRECT FLOW TURBINE

BACKGROUND OF THE INVENTION

1. Field of the Invention

The invention relates to a vacuum cleaning tool for a vacuum cleaning device comprising a housing in which a brush chamber and a turbine chamber are provided. A working roller, in particular, a brush roller, is arranged in the brush chamber transversely to the working direction of the suction cleaning tool. The working roller penetrates with a peripheral portion a suction slot provided in the bottom of the brush chamber. An air turbine is arranged in the turbine chamber for driving in rotation the working roller. A vacuum air flow of the vacuum cleaning tool enters the brush chamber via the suction slot, flows into the turbine chamber via an intake window provided in a partition between the brush chamber and the turbine chamber, and exits from the turbine chamber through an outlet window of a vacuum connector. Between neighboring vanes of an annular vane arrangement of the air turbine free flow paths to a vane-free center of the air turbine are formed; the vacuum airflow passes through the vane-free center of the air turbine along its path from the intake window to the outlet window of the vacuum connector.

2. Description of the Related Art

A vacuum cleaning tool of this kind is known from U.S. Pat. No. 5,249,333. A brush chamber and a turbine chamber are formed in the housing. A brush roller is rotatably supported in the brush chamber transversely to the working direction of the suction tool. A peripheral portion of the brush roller penetrates with its bristles through the suction slot provided in the bottom of the brush chamber in order to mechanically act on the floor surface to be cleaned. In the turbine chamber an air turbine is arranged which drives rotatably the brush roller by means of a belt drive. The vacuum airflow enters the vacuum cleaning device through the suction slot in the brush chamber, flows via an intake window in a partition between the brush chamber and the turbine chamber into the turbine chamber, and flows out of the turbine chamber via an outlet window which is provided in a vacuum connector. When doing so, the vacuum airflow flows to the vane-free center of the air turbine between neighboring vanes of an annular vane arrangement of the air turbine and flows again through the annular vane arrangement along its exit path when exiting through the outlet window. As a result of this flow path, a strong power output at the air turbine is obtained, wherein power magnitudes can be achieved matching those of an electric motor used in vacuum cleaning tools.

SUMMARY OF THE INVENTION

It is an object of the present invention to optimize the power output of a direct flow turbine in order to ensure even for a weaker vacuum airflow a strong power output and thus a powerful drive action on the working roller.

In accordance with the present invention, this is achieved in that in the flow direction of the vacuum airflow the outlet window of the vacuum connector is positioned higher than the intake window of the partition, in that the annular vane arrangement has approximately 10 to 14 vanes, in that an imaginary connecting line between approximately the center of the intake window and approximately the center of the outlet window intersects the cross-section of the air turbine as a secant, and in that in the circular arc of the circle segment separated by the secant approximately four to six vanes of the annular vane arrangement of the air turbine are positioned.

For an optimal use of the energy of the vacuum airflow by means of the air turbine it must be firstly ensured that in the flow direction of the vacuum airflow the outlet window is positioned higher than the intake window. The annular vane arrangement of a suitable air turbine should in this respect have approximately 10 to 14 vanes which are arranged uniformly about the circumference with an equidistant circumferential spacing to one another. The position of the intake window allowing flow into the turbine chamber and of the outlet window allowing the flow to exit the turbine chamber as well as the arrangement of the air turbine between these two windows positioned at different levels should be such that an imaginary connecting line between the center of the intake window and approximately the center of the outlet window intersects the cross-section of the air turbine as a secant. In the circular arc of the circle segment separated by the secant, advantageously approximately four to six vanes of the annular vane arrangement of the air turbine are to be positioned. This means that the length measured in the circumferential direction of the circular arc of the circle segment separated by the secant is identical to the circumferential distance between approximately five successively arranged vanes. With such a configuration the vacuum airflow will enter approximately at vane I and will exit at the level of the fifth vane V leading in the rotary direction.

A further configuration of the invention provides that the height of the intake window and the height of the outlet window within the housing are adjusted relative to one another such that a connecting line between the upper edge of the intake window and the upper edge of the outlet window extends below the hub of the air turbine. This ensures that the hub of the air turbine is not positioned in the direct flow path of the vacuum airflow flowing through the turbine center.

The surface area of the circle segment separated by the connecting line can correspond approximately to 30% to 45% of the cross-sectional surface area of the air turbine.

An excellent power output has been observed when the vanes of the annular vane arrangement are positioned relative to a radial line through the base of the vane at an angle of approximately 35° to 55°, preferably 45°. The vanes are curved in the direction of rotation wherein the annular vane arrangement extends across a radial height of at least 30% of the radius of the air turbine.

In order to ensure entry of the vacuum airflow into the center of the air turbine, the mantle surface of the air turbine is positioned at a minimal spacing relative to the turbine chamber bottom. The arrangement of the intake window is such in this connection that its lower edge is positioned approximately at the level of the chamber bottom and the upper edge of the intake window is positioned approximately below the lower edge of the outlet window.

In a further configuration concerning the position of the air turbine in the turbine chamber, it is advantageous to position the axis of rotation, even better, the hub of the air turbine, in the vicinity of the bisecting line which divides the angle, in particular, a right angle, between the partition at the level of the intake window and the chamber bottom. In particular, the bisecting line can be a tangent on the hub of the air turbine wherein the hub is positioned at a side relative to the bisecting line facing the turbine chamber bottom.

For assisting the guiding action of the airflow, it may be provided to configure the turbine chamber bottom in the outflow area of the vacuum airflow from the turbine chamber as a ramp ascending toward the outlet window. Preferably, a groove is provided within the ramp which extends in the flow direction of the vacuum airflow. Its edge facing the outlet window in the flow direction of the vacuum airflow at least substantially covers the housing edge of the outlet window.

DESCRIPTION OF THE PREFERRED EMBODIMENTS

Figure 1:
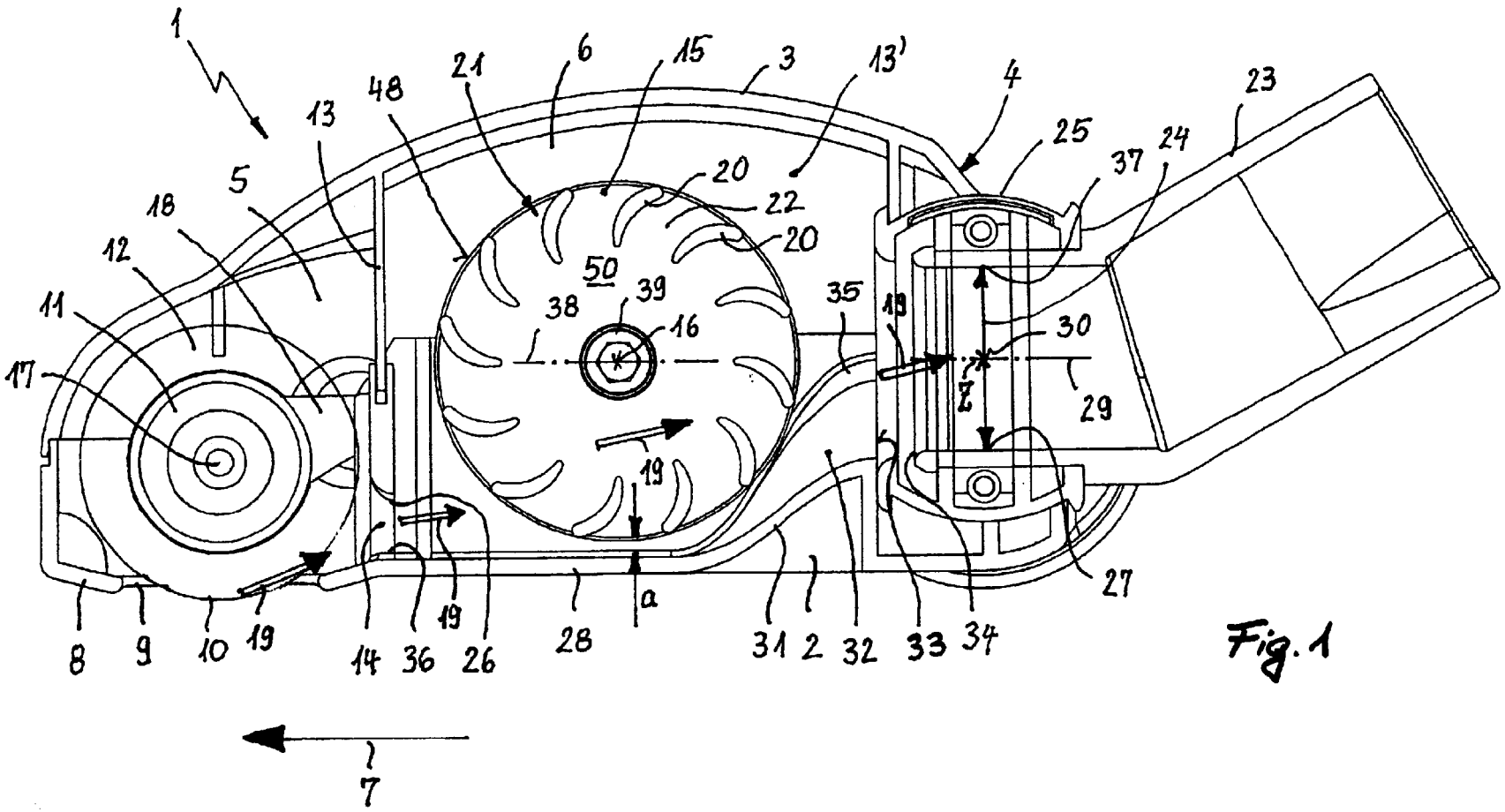
FIG. 1 is a section of the vacuum cleaning tool according to the invention.

The vacuum cleaning tool 1 illustrated in FIG. 1 has a housing 4 which is comprised of a bottom housing part 2 and a top housing part 3. In the interior of the housing 4 a brush chamber 5 as well as a turbine chamber 6 are provided.

In the brush chamber 5, positioned in a leading position with respect to the working direction 7 of the vacuum cleaning tool 1, a working roller 11 is arranged transversely to the working direction 7. In the shown embodiment the roller 11 is a brush roller. The working roller 11 projects with a peripheral portion 10 from the suction slot 9 to the exterior. The suction slot 9 is provided in the bottom 8 of the brush chamber 5 and extends across the entire width of the working tool 1 transversely to the working direction 7. In the embodiment of the working roller 11 as a brush roller the bristles of the brush arrangement 12 project from the suction slot 9 to the exterior of the housing 4.

The brush chamber 5 is separated from the turbine chamber 6 by a partition 13 which in the bottom area has an intake window 14 for allowing passage of the vacuum airflow 19 into the turbine chamber 6. The intake window 14 has a substantially rectangular shape and extends across the width of the air turbine 15 arranged in the turbine chamber 6.

The air turbine 15 is supported, close to the partition 13 and close to the turbine chamber bottom 28, on an axis of rotation 16 which extends transversely to the working direction 7 in the sidewalls 13' of the turbine chamber 6. The turbine 16, driven by the vacuum airflow 19, drives in rotation the working roller 11 about its bearing axle 17 by means of a belt drive 18.

In order to provide a high turbine power, free flow paths 22 are provided between neighboring vanes 20 of an annular vane arrangement 21 of the air turbine 15 which lead to a vane-free center 50. In this way, a vacuum airflow 19 entering the turbine chamber 6 will enter via the flow paths 22 between neighboring vanes 20 into the vane-free center 50 of the air turbine 15 and will exit from the center 50, while passing again through the annular vane arrangement 21, in order to then exit the turbine chamber 6 through the outlet window 24 provided at the rear end of the turbine chamber 6.

The outlet window 24 is positioned higher within the housing 4 than the intake window 14 in the flow direction of the vacuum airflow 19. For example, the upper edge 26 of the intake window 14 is positioned at the same level or lower, preferably somewhat below the lower edge 27 of the outlet window 24. The outlet window 24 is determined by the cross-section of the vacuum connector 23 which is rotatably supported in a part-cylindrical swivel part 25 about a central axis of rotation 29. The swivel part 25 is pivotable about a swivel axis 30, located on the rotary axes 29, transversely to the working direction 7. The center Z of the outlet window 24, which corresponds to the point of intersection of the axes 29 and 30, is thus fixedly positioned relative to the turbine chamber 6 even for swivel movements about the swivel axis 30. Only the lower edge 27 and the upper edge 37 of the outlet window 24 swivel about a portion of a circular arc wherein, however, as a result of the limited pivotability about the swivel axis 30 the thus resulting height change of the edges are so small that they can be neglected.

The intake window 14, which is substantially rectangular, is limited by the turbine chamber bottom 28. The lower edge 36 of the intake window 14 is positioned approximately at the level of the turbine chamber bottom 28. The substantially circular cross-section of the outlet window 24 is greater, preferably several times greater, than the cross-section of the intake window 14.

In order to guide the vacuum airflow as disruption-free as possible from the intake opening 14 to the outlet window 24 through the turbine chamber 6 and the air turbine 15 while providing the greatest possible power output, the height difference between the intake window 14 and the outlet window 24 within the housing 4 is compensated by a ramp 31. The ramp 31 begins, in the flow direction of the vacuum airflow 19, approximately behind the axis of rotation 16 of the air turbine 15 and ascends uniformly up to the lower edge 27 of the outlet window 24. In order to obtain a directed flow into the outlet window 24, a groove 32 is formed within the ramp 31 and extends in the flow direction of the vacuum airflow 19. Its edge 33 facing the outlet window 24 covers at least substantially the housing edge 34 of the outlet window 24. In the vicinity of the air turbine 15, the groove 32, measured transversely to the flow direction of the vacuum airflow 19, is slightly wider than the width of the air turbine 15 measured in the direction of the axis of rotation 16. In the direction toward the outlet window 24, the groove 32 tapers to the diameter of the outlet window 24, wherein the cross-section of the groove 31 corresponds at its end facing the outlet window 24 to half the cross-section of the outlet window 24. In this connection, the edge 33 of the groove 32 substantially covers the housing edge 34 of the outlet window 24 in the flow direction of the vacuum airflow 19. In a preferred embodiment, the trough-like groove 32 can also extend into the outlet window 24, preferably can project into it. Expediently, at the outflow end of the groove 32 the sidewalls 35 extend approximately to half the height of the outlet window 24.

Figure 2:
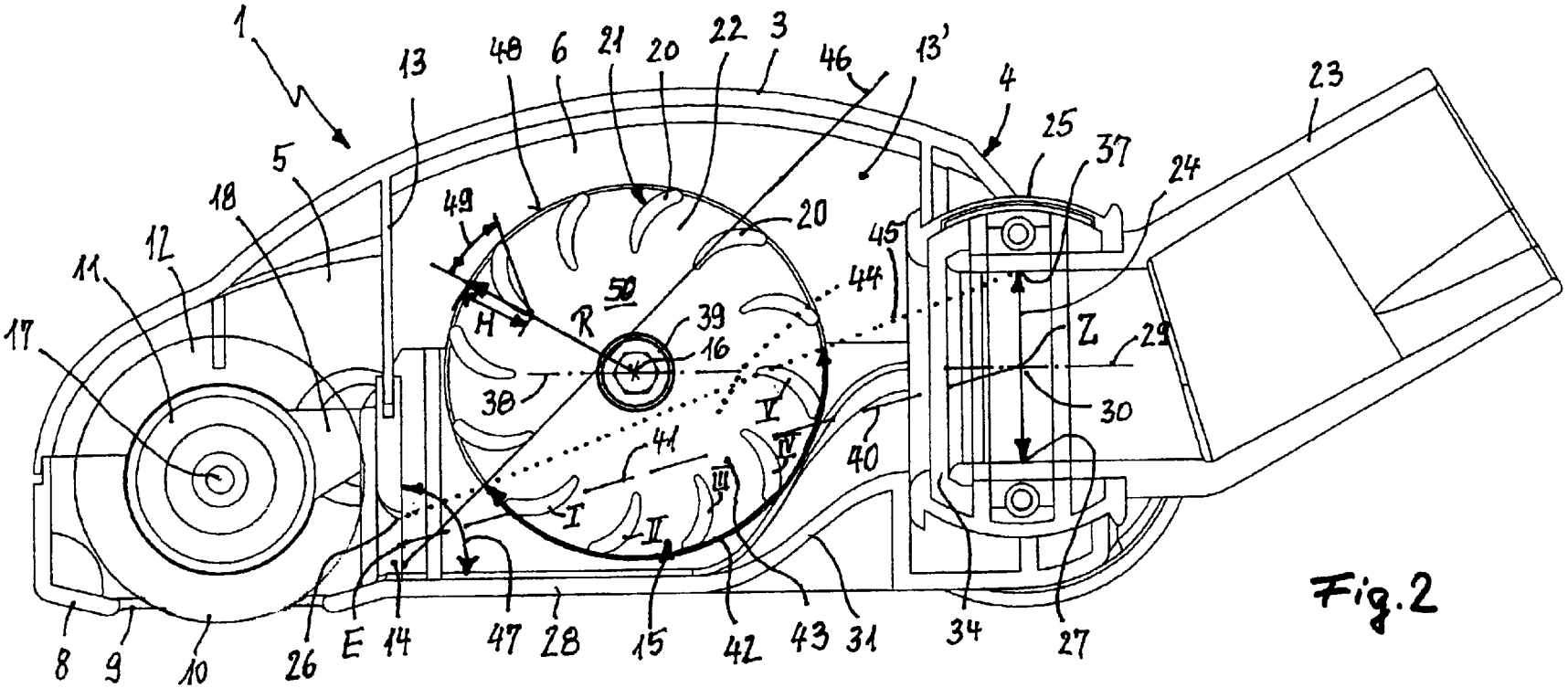
FIG. 2 shows a section according to FIG. 1 with imaginary connecting lines being illustrated.

In order to ensure flow through the turbine with high power output, the annular vane arrangement has approximately 10 to 14 vanes 20. In this connection, the position of the air turbine 15 and of the turbine chamber 6 relative to the intake window 14 and the higher-positioned outlet window 24 is such that an imaginary connecting line 40 approximately between the center E of the intake window 14 and the center Z of the outlet window 24 intersects as a secant 14 the air turbine. The circular arc 42 of the circle segment 43 separated by the secant 41 comprises approximately four to six, in particular, five, vanes 20. In the view illustrated in FIG. 2 the circular arc 42 of the circle segment 43 extends from a first vane I to a fifth vane V. With such a configuration of the air turbine 15 in combination with the height displacement of the intake window 14 relative to the outlet window 24, an excellent power output of the air turbine 15 was obtained in practice. As can be seen in the view according to FIG. 2, the air turbine 15 with its axis of rotation 16 is provided at the level of the axis of rotation 29 of the vacuum connector 23. In this connection, the axis of rotation 16 of the air turbine 15 as well as the center Z of the outlet window 24 are preferably positioned on the longitudinal center axis 38 of the advantageously symmetrically embodied turbine chamber 6.

The configuration of the geometric dimensions of the intake window 14 and the outlet window 24 are selected such that the connecting line 45 between the upper edge 26 of the intake window 14 and the upper edge 37 of the outlet window 24 extend below the axis of rotation 16, preferably below the hub 39 of the air turbine 15. The position of the upper edge 26 of the intake window 14 and the upper edge 37 of the outlet window 24 is selected such that in the circle segment 44 separated by the connecting line 45 in any rotational position of the air turbine 15 five individual vanes I to V are positioned. The vanes 20 of the annular vane arrangement 21 are positioned relative to a radial line R extending through their base, respectively, at an angle of approximately 35° to 55°, preferably approximately 45°, with respect to a line extending through the base and the top of the vane, respectively. In this connection, the radial height H of the annular vane arrangement 21 extends approximately across 25% to 40%, preferably 30%, of the radius R of the air turbine 15.

In a further embodiment, the surface area of the circle segment 43 or 44 is selected such that it is approximately 30% to 45% of the cross-sectional surface area of the air turbine 15.

In yet another embodiment of the vacuum cleaning tool, it is provided to arrange the air turbine 15 such that its axis of rotation 16 is positioned near the bisecting line 46 which divides the angle 47 between the partition 13 and the turbine chamber bottom 28. Preferably, the axis of rotation 16 is positioned on the side of the bisecting line 46 facing the turbine chamber bottom 28. In a special embodiment, the bisecting line 46 forms approximately a tangent on the hub 39 of the air turbine 15.

It may be expedient to adjust the air turbine 15 as well as the intake opening 14 and the outlet opening 24 relative to one another such that the hub 39 is contacted, on the one hand, by the bisecting line 46 and, on the other hand, by the connecting line 45. Such an adjustment ensures a forceful drive action of the air turbine 15 wherein the vacuum airflow 19 enters the vane-free center 50 of the air turbine 15 and exits therefrom in a directed way in order to flow out through the outlet window 24. In this connection, the provided ramp 31 of the turbine chamber bottom 28 ensures a substantially turbulence-free guiding of the vacuum airflow out of the turbine chamber, and this is beneficial in particular in regard to the power output of the air turbine 15.

While specific embodiments of the invention have been shown and described in detail to illustrate the inventive principles, it will be understood that the invention may be embodied otherwise without departing from such principles.

What is claimed is:

1. A vacuum cleaning tool for a vacuum cleaning device, the vacuum cleaning tool comprising:

a housing (4) having a partition (13) dividing an interior of the housing (4) into a brush chamber (5) and a turbine chamber (6), wherein the brush chamber (5) has a bottom (8) and vacuum slot (9) arranged in the bottom (8), and wherein the partition (13) has an intake window (14);

a vacuum connector (23) connected to the housing (4) remote from the brush chamber (5), wherein the vacuum connector (23) has an outlet window (24);

a working roller (11) arranged in the brush chamber (5) perpendicularly to a working direction (7) of the vacuum cleaning tool and having a peripheral portion (10) projecting from the brush chamber (5) through the vacuum slot (9) to the exterior of the housing (4);

an air turbine (15) arranged in the turbine chamber (6) and configured to drive in rotation the working roller (5);

wherein the air turbine (15) has vanes (20) arranged in an annular vane arrangement (21) with a vane-free center (50), wherein between the vanes (20) free flow paths (22) are provided extending toward the vane-free center (50);

wherein a vacuum air flow (19) enters the brush chamber (5) via the suction slot (9), flows from the brush chamber (5) through the intake window (14) into the turbine chamber (6), flows within the turbine chamber (6) from the intake window (14) to the outlet window (24) through the vane-free center (50), and exits from the turbine chamber (6) through the outlet window (24);

wherein in a flow direction of the vacuum air flow (19) the outlet window (24) is higher than the intake window (14);

wherein the annular vane arrangement comprises 10–14 vanes (20);

wherein an imaginary connecting line between a central area of the intake window (14) and a central area of the outlet window (24) intersects the air turbine (15) as a secant (41) to define a circle segment (43, 44) with a circular arc (42), and wherein along the circular arc (42) four to six of the vanes (20) of the annular vane arrangement (21) are arranged;

wherein the air turbine (15) has a mantle surface (47) and wherein the turbine chamber (6) has a chamber bottom (28), wherein the mantle surface (47) of the air turbine (15) is positioned at a spacing (a) to the chamber bottom (28);

wherein the intake window (14) has a lower edge (36) and an upper edge (26), wherein the lower edge (36) is positioned at the level of the chamber bottom (28).

2. The vacuum cleaning tool according to claim 1, wherein the working roller is a brush roller (11).

3. The vacuum cleaning tool according to claim 1, wherein the intake window (14) has an upper edge (26) and the outlet window (24) has an upper edge (37), wherein a connecting line (45) between the upper edge (26) of the intake window (14) and the upper edge (37) of the outlet window (24) extends below a hub (39) of the air turbine (15).

4. The vacuum cleaning tool according to claim 1, wherein a surface area of the circle segment (43, 44) is substantially 30% to 45% of a cross-sectional surface area of the air turbine (15).

5. The vacuum cleaning tool according to claim 1, wherein the vanes (20) of the annular vane arrangement (21) have a base pointing toward the vane-free center (50) and a top remote from the vane-free center (50), wherein a line connecting the top and the base of the vanes (20), respectively, and a radial line extending through the base of the vanes (20), respectively, are positioned at an angle of substantially 35° to 55° relative to one another.

6. The vacuum cleaning tool according to claim 5, wherein the line connecting the top and the base of the vanes (20) and the radial line extending through the base of the vanes (20) are positioned at an angle of substantially 45° relative to one another.

7. The vacuum cleaning tool according to claim 1, wherein the annular vane arrangement (21) has a radial height (H) of substantially 25% to 40% of the radius of the air turbine (15).

8. The vacuum cleaning tool according to claim 7, wherein the radial height (H) of the annular vane arrangement (21) is 30%.

9. The vacuum cleaning tool according to claim 1, wherein the outlet window (24) has a lower edge (27) and wherein the upper edge (26) of the intake window (14) is positioned approximately below the lower edge (27) of the outlet window (24).

10. The vacuum cleaning tool according to claim 1, wherein between the partition (13) and the chamber bottom (28) an angle (47) is defined and wherein an axis of rotation (16) of the air turbine (15) is arranged within the area of a bisecting line (46) of the angle (47) between the partition (13) and the chamber bottom (28).

11. The vacuum cleaning tool according to claim 10, wherein the axis of rotation (16) is positioned below the bisecting line (46) of the angle.

12. The vacuum cleaning tool according to claim 1, wherein a cross-section of the outlet window (24) is greater than a cross-section of the intake window (14).

13. The vacuum cleaning tool according to claim 12, wherein the cross-section of the outlet window (24) is circular and wherein the cross-section of the intake window (14) is rectangular, and wherein the cross-section of the outlet window (24) is greater than the cross-section of the intake window (14).

14. The vacuum cleaning tool according to claim 1, wherein the turbine chamber (6) has a chamber bottom (28) and wherein the chamber bottom (28) has a ramp (31) ascending toward the outlet window (24) in the area where the vacuum airflow (19) exits from the turbine chamber (6).

15. The vacuum cleaning tool according to claim 14, wherein the ascending ramp (31) comprises a groove (32) extending in the flow direction of the vacuum air flow (19), wherein the groove (32) has an edge (33) facing the outlet window (24) in the flow direction of the vacuum air flow (19) and the edge (33) covers at least substantially the housing edge (34) of the outlet window (24).

16. The vacuum cleaning tool according to claim 15, wherein the width of the opening of the groove (32) measured perpendicularly to the flow direction of the vacuum airflow (19) is slightly greater in the area of the air turbine (15) than the width of the air turbine (15) measured in the direction of the axis (16) of rotation.

17. The vacuum cleaning tool according to claim 15, wherein an end of the groove (32) at the outlet side has sidewalls (35) ending approximately at half the height of the outlet window (24).

18. The vacuum cleaning tool according to claim 15, wherein the groove (32) is trough-shaped and extends to the outlet window (24).

19. The vacuum cleaning tool according to claim 18, wherein the groove (32) projects into the outlet window (24).

20. The vacuum cleaning tool according to claim 15, wherein a cross-section of the end of the groove (32) matched substantially half a cross-section of the outlet window (24), wherein the cross-section of the end of the groove in the flow direction of the vacuum airflow (19) covers at least substantially the edge (34) of the outlet window (24).

* * * * *